United States Patent [19]

Delahunty

[11] Patent Number: 4,621,684

[45] Date of Patent: Nov. 11, 1986

[54] ROTARY HEAT EXCHANGER WITH CIRCUMFERENTIAL PASSAGES

[76] Inventor: Terry W. Delahunty, Rte. 1, Box 80, Tioga, Tex. 76271

[21] Appl. No.: 693,336

[22] Filed: Jan. 22, 1985

[51] Int. Cl.[4] ..... F28F 5/00

[52] U.S. Cl. ..... 165/92; 165/120

[58] Field of Search ..... 165/92, 120

[56] References Cited

U.S. PATENT DOCUMENTS

| | | | |
|---|---|---|---|
| 3,260,306 | 7/1966 | Laing | 165/92 X |
| 3,800,865 | 4/1974 | Onarheim et al. | 165/92 |
| 3,923,097 | 12/1975 | Hourd | 165/92 |
| 3,951,206 | 4/1976 | Williams et al. | 165/92 |
| 3,989,101 | 11/1976 | Manfredi | 62/499 X |
| 4,301,860 | 11/1981 | Pozzi | 165/92 X |

FOREIGN PATENT DOCUMENTS

| | | | |
|---|---|---|---|
| 2453244 | 5/1976 | Fed. Rep. of Germany | 165/92 |

*Primary Examiner*—Albert W. Davis, Jr.
*Assistant Examiner*—Randolph A. Smith

[57] ABSTRACT

The heat exchanger is composed of a plurality of heat conducting finned discs materially shaped and joined to form concentrically and annularly disposed, circumferential passages for isolated flow of fluid streams in indirect countercurrent, cocurrent, and series heat exchange relationship. The circumferential passages are provided with axial flow apertures for axial transport of fluid streams through the rotary heat exchanger and enable recovery of the mechanical energies transferred to the fluid streams by the rotative surfaces. The energy recovery feature facilitates high speed designs in which large relative velocities are maintained between the fluid streams and rotative surfaces. Enhanced heat transfer with low friction losses is achieved.

8 Claims, 16 Drawing Figures

ROTARY HEAT EXCHANGER WITH CIRCUMFERENTIAL PASSAGES

BACKGROUND OF THE INVENTION

1. Field of the Invention

This invention describes a method and apparatus applicable to heat exchange devices wherewith high heat transfer efficiency can be achieved with inconsiderable power requirements necessary to overcome the fluid frictional resistances directly related to heat transfer. More particularly, this invention relates to high heat flux rotary type heat exchangers having flexibility to accommodate two or more streams in countercurrent, cocurrent, and series arrangements, and having a simply constructed, discretionary means to substantially or partially recover the mechanical energies transferred to the fluid streams during heat exchange.

2. Description of the Prior Art

Conventional heat exchangers both stationary and rotary consume power during the exchange of heat between fluid streams. With stationary heat exchangers the power is irreversibly lost, that is, the kinetic energy imparted to the fluid to cause flow along the heat conducting surface cannot be conveniently recovered. Contrastly many types of rotary heat exchangers offer the potential for practical power recovery, since kinetic energy is commonly added to the fluid. However, this inherent advantage has not been utilized except in specialized applications which routinely require heat transfer in conjunction with pumping or fan action. Thus rotary exchangers have remained well known in the art but little used in applications.

Three basic types of rotary heat exchange devices are available to the prior art. The first and perhaps most widely known and applied is the axial flow type. Most recent vintage art is applied to improvements in materials, fluid seals, and physical stability under high temperature environments. The second type includes the radial flow devices, which are characterized by less developed art and more limited application. Recent art teaches new configurations advantageous to novel applications and performance improvements generally pertaining to increased surface area per volume occupied by the device. The third type commonly involves binary or infrequently tertiary combinations of axial, circumferential, or radial flow arrangements, having art and applications similar to the above radial flow devices.

In axial heat exchangers gases pass axially through a cylindrically shaped core. Hot gas flows through one portion while cold gas flows countercurrently through the other. A longitudinal seal separates the hot portion from the cold portion preventing leakage between hot and cold gases. By rotating the core, heat is continually transported from the hot gas to the cold gas via the heat conducting capacitance of the core material. The cores of axial heat exchangers are made of heat resistant alloy metals or ceramic materials in a closely spaced matrix form. The matrix design seeks to maximize heat transfer surface area while minimizing flowing pressure losses imposed by gas movement through the matrix. The matrix design further seeks to minimize the quantities of gases transported from one core portion to another by its rotation, thereby implicating core length, rotational speed, and flowing pressure losses into the design objectives. These and other characteristics are well known. U.S. Pat. No. 4,331,198 describes this art and discloses improvements on inherent problems, while U.S. Pat. No. 4,174,748 presents a novel, radially configured rotary core.

In radial type rotary heat exchangers, the heat transfer surfaces separating two fluid streams are provided by circular discs affixed to a rotating shaft. Commonly, as disclosed in U.S. Pat. No. 4,431,048, a first large volume rate stream flows radially outward along the disc's external surfaces from a central, axially aligned cylindrical ductway. The second, relatively small volume rate stream flows radially outward then radially inward inside internal passages formed within the discs. Normally, radial heat exchanges are used only in applications in which the first stream requires the pumping or fan action imparted by disc rotation.

In mixed flow rotary heat exchangers, several combinations are available to the art. Usually, applications are restricted to pumping or fan action situations. The radial/axial configuration, such as U.S. Pat. No. 3,989,101, generally cites flow of a first high volume rate, low pressure stream from a central distributor duct into radially outward disposed heat exchange passages. The low volume rate, frequently pressurized second stream flows within axially aligned conduits. A series of plates embodies the radial passages and supports the axial conduits. Another common mixed flow configuration involves the radial/circumferential alternative as taught in U.S. Pat. No. 4,073,338. This art is similar to the above radial/axial configuration except that the channels for the low volume rate stream are annular circumferential tubes or hollow discs. In still other citations, less known configurations are presented. U.S. Pat. No. 4,074,751 teaches an axial/circumferential arrangement comprising circumferential tubes in combination with axial flow area formed by the rotor enclosure. Adjunctly, U.S. Pat. No. 3,424,234 teaches a tertiary flow arrangement involving radial flow of a large volume rate, low pressure stream and a circumferential/axial flow complexity for the small volume rate stream.

In these known rotary exchangers three common problems arise which this invention proposes resolving.

The first problem concerns the heat transfer rate between material surfaces and the fluid streams. In most types of rotary exchangers, the convective coefficient is undesirably low. For example, U.S. Pat. No. 4,331,198 cites nominal axial type convective coefficients ranging from 3.2 to 6.8 BTU/HrFt$^2$ °F. as common for the hot and cold gases. In further complicity laboratory researchers at Michigan Technological University report that heat transfer to a fluid in radial flow between two corotating discs is only slightly affected by rotation; that is, heat transfer from stationary discs is essentially the same as that observed from discs rotating at moderately high speeds (200 to 600 RPM test conditions).

The second problem concerns the pumping or fan action imparted to the fluid streams by the radially oriented rotative members. In many applications this action is undesirable and a burden on the mechanical energy required to maintain rotation.

The third problem concerns the limited flexibility of known rotary heat exchangers to continuously accommodate more than two streams in various combinations of countercurrent, cocurrent, and series flow arrangements. In all known prior art citations, a two stream configuration was disclosed. It is a reasonable assumption that the previous two problems are important factors having influence over the limited flexibility.

SUMMARY OF THE INVENTION

According to the present invention there is provided a method for improved rotary heat exchange efficiency and for substantially reduced power required to achieve high heat fluxes. The method comprises a repetitious series of three processes whereby large relative velocities are maintained between the fluid streams and the heat conducting surfaces separating the fluid streams, and whereby the mechanical energies transferred to the streams during heat exchange are substantially or selectively recovered. The three processes—(1) Indirect rotary heat exchange, (2) Acceleration of selected streams in a direction perpendicular to the heat conducting surfaces, and (3) Redirection of the selected streams causing a reduction of fluid velocity in a direction parallel to the heat conducting surfaces—can be accomplished in many well known rotary heat exchanges but more effectively in the new and novel apparatus of this invention.

Further according to the present invention there is provided an apparatus for affecting efficient and less power consuming heat transfer between two or more fluid streams comprising, a rotative element or plurality of elements, each with circumferential passages formed from circular heat conducting finned discs, materially joined and including interconnecting orifices or apertures which enable acceleration and redirection of selected fluid streams as discussed above. Said apparatus further comprising a rotative shaft for support of the rotative elements and transport of designated fluid streams to and from rotative elements, manifold finned discs for transporting designated fluid streams to and from finned discs, enclosure means with inlet and outlet ports for primary fluid streams, and alternative partition discs enabling separated series flow of primary fluid streams.

Other objects and a fuller understanding of the embodiments of the invention may be had by referring to the following description and claims, taken in conjunction with the accompanying drawings.

DESCRIPTION OF THE PREFERRED EMBODIMENT

In the following description, the present invention will be described in more detail using examples shown in the attached drawings. The apparatus embodiments will first be described, enabling better understanding by those skilled in the art of the secondly described method embodiments and its salient benefits.

Figure 1:
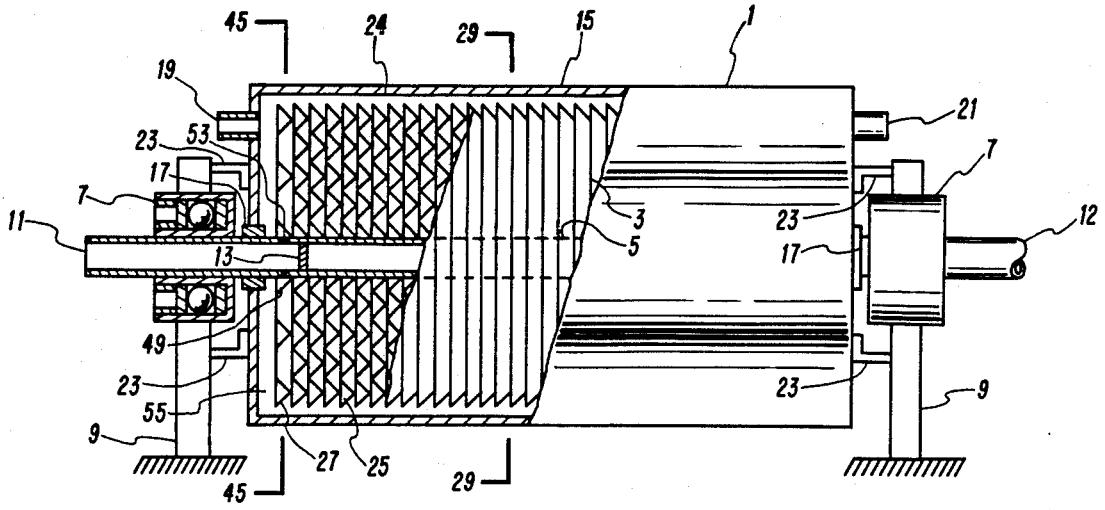
FIG. 1 is a schematic, partially sectioned in two regions, overall view of the rotary heat exchanger according to one embodiment of this invention.

FIG. 1 is a schematic representation of the present invention, having a right and left symmetrical, rotary heat exchanger 1 containing a cylindrically shaped rotary heat exchange element 3. The rotary heat exchange element is affixed to and supported by rotative shaft 5. The rotative shaft is supported by bearings 7 which are rigidly mounted to stationary support frames 9. The rotative shaft is a hollow, preferably circular shaft, open at ends 11 and 12 but including shaft sealing means 13. Alternatively, the shaft could be a solid metal shaft machine bored to provide hollow shaft regions as required. Although not shown, it is understood the rotative shaft could further comprise a means such as pulley, gearing or direct drive coupling for imparting torque to the rotary heat exchange element and rotary couplings that could facilitate sealed intake and discharge of fluid streams between stationary conduits and the rotative shaft. The rotary heat exchange element is shown isolated from the surroundings by an enclosure 15 comprising seals 17, intake or discharge conduits 19 and 21, and support means 23 suitably attached to support frames 9. The enclosure is further shown in close proximity to the peripheral edges of the rotative heat exchanger element thereby offering a sealing effect in regions 24. Said sealing effect could be accomplished by other means well known in the art. Although the rotary heat exchange element is shown with an enclosure, it is understood that certain useful heat exchange operations could be accomplished without an enclosure.

The rotary heat exchange element is constructed from a plurality of finned discs made of thin heat conducting metal or polymeric material and affixed together in abutting relationship by gluing with an adhesive, welding, or brazing. As shown in FIG. 1, the rotary heat exchange element 3 comprises at least two types of finned discs. The possibility for more than two types will become more clear in subsequent descriptions. The interior regions of the rotary heat exchange element are provided with a plurality of central finned discs 25. The two external circular faces of the rotary heat exchange element each comprise a manifold finned discs 27 (only one shown), having left and right orientations one to another.

Figure 3:
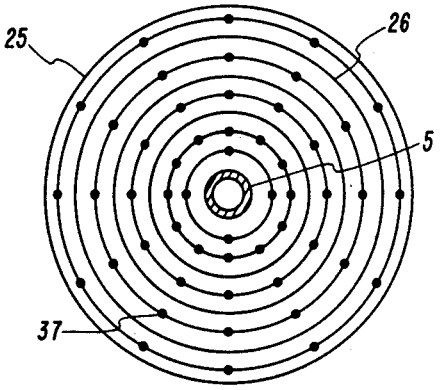
FIG. 3 is a schematic sectional view showing facial details of a central finned disc according to section 29 of FIG. 1.
Figure 6:
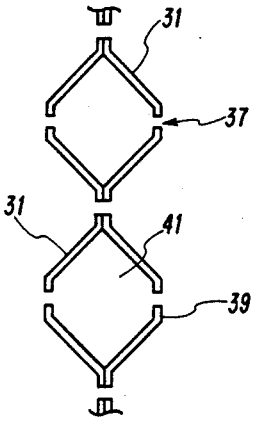
FIGS. 6, 7, and 8 are fragmented schematic cross sectional views of alternative geometrical shapes of circumferential passages formed in finned discs.
Figure 7:
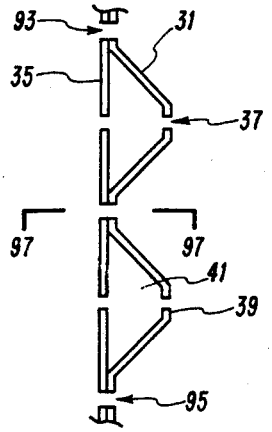
Figure 8:
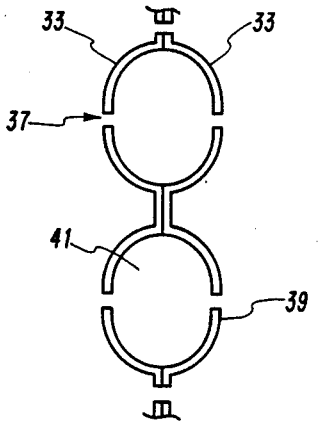

The central finned disc 25, shown in FIG. 3 by side sectional schematic view 29 taken in FIG. 1, is characterized by a plurality of annular ring appearing, circumferential passages 26 preferably concentric with the rotative shaft 5. The central finned discs are formed by affixing together two corrugated or one flat and one corrugated circular discs as illustrated in exploded, sectional, schematic views FIGS. 6, 7, and 8. These figures illustrate several alternative configurations of shape and abutting relationship, but it is understood that the alternatives are not limiting. FIG. 6 illustrates two rectilinear, corrugated circular discs 31 joined together. FIG. 7 illustrates one rectilinearly corrugated circular disc 31 and one flat circular disc 35 joined together. FIG. 8 illustrates an alternative shape of two curvilinearly corrugated circular discs 33 joined together. The central finned discs of FIGS. 6, 7, and 8 are provided with a plurality of apertures 37 which allow axially oriented fluid stream communication between and across abutting central finned discs. The apertures may comprise simple circular or rectilinear communication paths or may comprise special configuration under the present invention. The apertures are periodically spaced about the circumference of the circumferential passages 26 as shown in FIG. 3 and are positioned within the flat regions 39 depicted in FIGS. 6, 7, and 8.

Figure 9:
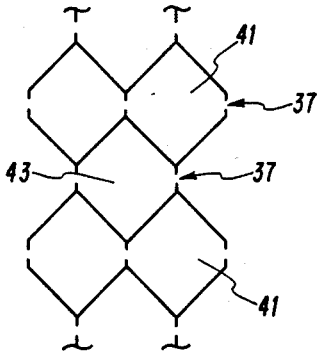
FIGS. 9 and 10 are fragmented schematic views of two alternative modes of joining finned discs.
Figure 10:
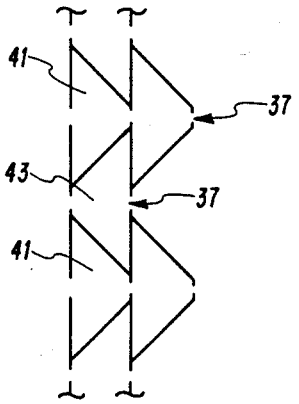

Upon affixing central finned discs together, either in a head to head arrangement shown in FIG. 9 or a head to tail arrangement shown in FIG. 10, circumferential passages 41 or 43 are thereby formed. With properly aligned abutment, the circumferential passages are sealed against radially oriented communication, having only axial communication provided by the apertures 37.

Figure 2:
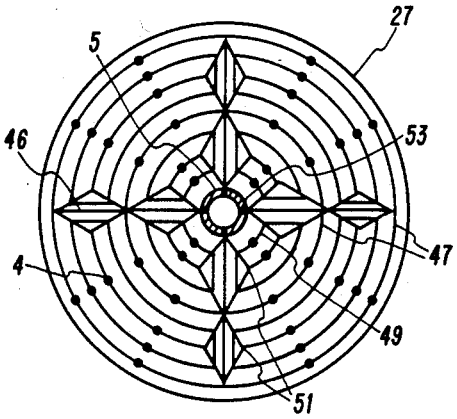
FIG. 2 is a schematic sectional view showing facial details of a manifold finned disc according to section 45 of FIG. 1.

The manifold finned discs 27 in FIG. 1 (only one shown) and further shown in FIG. 2 by enlarged side sectional schematic view 45 of FIG. 1, are similar to the central finned discs except in three provisions. First, a plurality of radially extended passageways 46 of convenient geometrical shape, preferably that of the central finned disc, provides selective communication with the circumferential passages formed within the manifold finned discs. As shown in FIG. 2, communication is provided to passages 47 and 49 while a sealed apart relationship is provided passages 51. Second, circumferential passage 49 communicates with the interior of the shaft via orifices 53. Third, the apertures for circumferential passages 47 and 49 , either simple or of the present invention, are provided on one side of the manifold finned disc, only permitting axial communication with the adjoining central finned disc.

Figure 11:
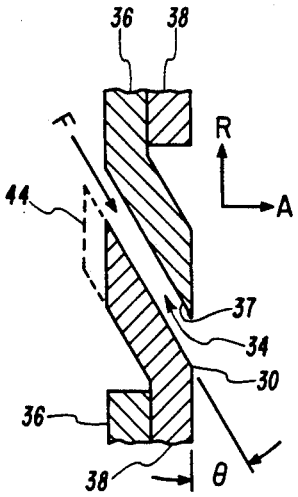
FIGS. 11, 12, and 13 are fragmented, magnified, cross-sectional schematic views of alternative forms of apertures according to the method of this invention.
Figure 12:
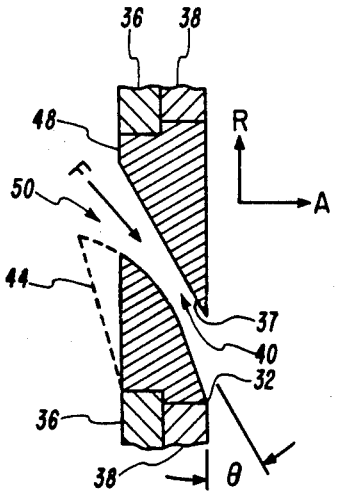
Figure 13:
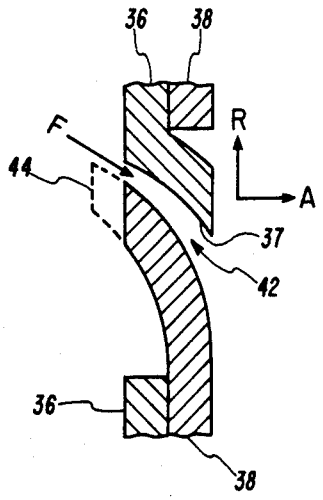

Alternative but not limiting forms of the apertures of the present invention are shown in FIGS. 11, 12, and 13 which are enlarged sectional schematic views looking radially inward along two abutted finned discs. Said apertures 37 comprise fluid stream flow passages, marked directionally by arrows F, oriented obliquely to the axial direction, arrow A, and in an opposite directional sense to that of rotation, arrow R. Said apertures further comprise geometrical shape and size convenient to the volumetric flow requirements of the through passing fluid streams, being for example of rectangular or circular cross-sectional area when viewed in facial perspective along direction F. Said apertures further comprise a flow nozzle with constant flow area 34, as illustrated in FIG. 11; a flow nozzle with converging flow area 50 followed by diverging flow area 40, illustrated in FIG. 12; or a flow nozzle with diverging flow area 42, as shown in FIG. 13. Said apertures are formed by cutting, removing, bending, and shaping alternate material walls of abutted finned discs 36 and 38 shown in FIG. 11 and FIG. 13 or formed by an insert 48 which replaces material removed from abutting finned discs 36 and 38 of FIG. 12. Apertures may comprise discretionary extensions 44 shown by dashed lines (FIGS. 11, 12, and 13) which would impart pumping or fan action to fluid streams. The extensions are an alternative modification enabling an assisting acceleration effect on the fluid streams according to the method of this invention.

Now the flow of fluids to interact in indirect, cocurrent heat transfer shall be described. FIGS. 1, 2, and 3 depict a two fluid rotary heat exchanger into which a designated fluid stream enters shaft 5 at open end 11 (FIG. 1), passing axially along the shaft to orifices 53 (FIGS. 1 and 2), wherewith the designated fluid stream is passed into the innermost circumferential passage 49 (FIGS. 1 and 2) of a first manifold finned disc 27 (FIGS. 1 and 2). The designated fluid stream is thereafter distributed to other more outwardly disposed circumferential passages 47 (FIG. 2) by radial passages 46 (FIG. 2). From circumferential passages 47 and 49 (FIG. 2), the designated fluid stream passes through the manifold finned disc apertures into the corresponding circumferential passages of the proximate central finned disc. After traversing the span of the central finned discs, flowing axially through apertures and circumferentially within circumferential passages, the designated fluid stream exits the rotary heat exchanger from shaft 5 at open end 12 along a manifold disc path similar to but in reverse order to its entrance. Now a second fluid stream, designated primary stream, enters the rotary heat exchanger through port 19 and passes into distributor space 55 whereafter it passes axially through manifold finned disc apertures, generally marked 4, FIG. 2, and into manifold finned disc circumferential passages 51, FIG. 2. The primary stream is then distributed via apertures to the corresponding circumferential passages of the proximate central finned discs, thereafter passing across the span of central finned discs, flowing axially through apertures and circumferentially through the circumferential passages of central finned discs. The primary stream then exits the rotary heat exchanger through port 21, having passed through the manifold finned disc and distributor space opposite to its entrance. Now further to fluid stream flows within the rotary exchanger of FIG. 1, it is obvious that a countercurrent heat exchange interaction could be achieved by reversing the flow of, say, the primary stream, entering at port 21 and exiting at port 19.

Figure 14:
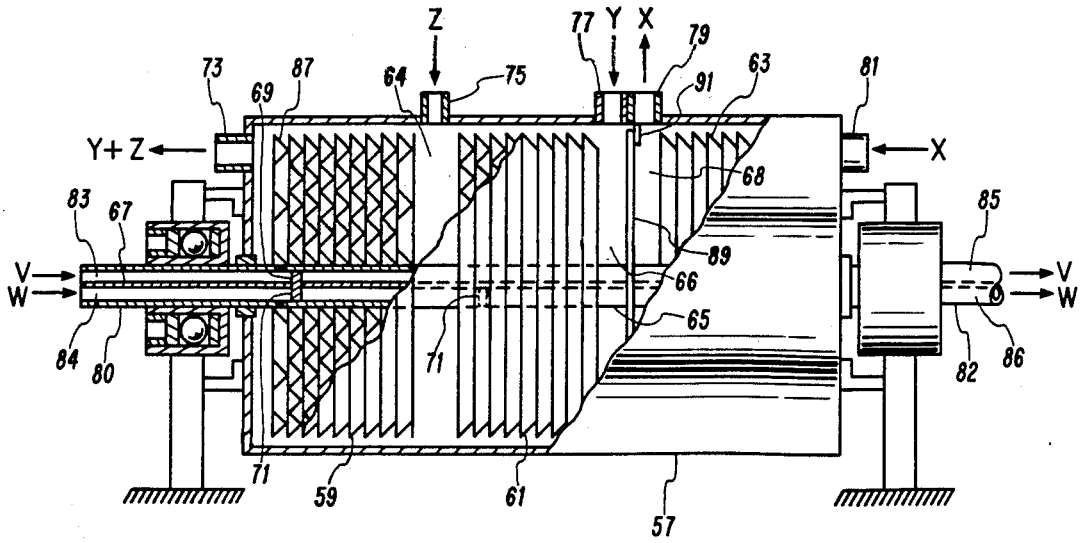
FIG. 14 is a schematic, partially sectioned in two regions, overall view of an alternative form of the rotary heat exchanger according to further embodiments of this invention.

FIG. 14 is a modification of the present invention shown in FIG. 1, incorporating further embodiments which illustrate apparatus flexibility to accommodate more than two fluid streams in various combinations of countercurrent, cocurrent, and series flow. Although FIG. 14 presents a certain degree of particularity, it is understood that the present disclosure is made only by example and that numerous changes in the details of the combination and the arrangement of parts may be resorted to without departing from the scope of the invention. Now according to FIG. 14, the rotary heat exchanger 57 is provided with three rotary heat exchange elements 59, 61, and 63; separated by distributor zones 64, 66, and 68; each element comprising manifold and central finned discs heretofore generally described; and supported by a rotative shaft 65 similarly journaled and supported for rotation according to the previous description of FIG. 1. However, said shaft is additionally provided with a partition means 67, of any convenient form such as annular, sectorial, or the like; dividing the internal hollow shaft into axial zones 83 and 84. The shaft is also provided with a plurality of sealing means 69 and 71 (one not shown), which enable isolated flow of primary streams into and from selected elements according to the previous discussion. The rotary heat exchanger is further provided with a partition disc 89 and sealing means 91 separating distribution zones 66 and 68 one from another.

A further modification required by the embodiments of FIG. 14 concerns the manifold finned discs 27 as shown in FIG. 2. Whereas FIG. 2 concerned a single designated stream, FIG. 14 requires simultaneous manifolding of two designated streams. Hence, imagine that the partition means 67 of FIG. 14 runs diagonally across the section of the shaft shown in FIG. 2. Accordingly, the channels 83 and 84 of FIG. 14 would each communicate separately with two of the four radially extended passageways 46 of FIG. 2. Secondly, imagine that the innermost circumferential passage 49 (FIG. 2) is partitioned into two annular circumferential segments corresponding to the division of the partition means. Now, with these modifications, it is possible to separately pass two designated streams from the shaft into the manifold finned disc inner most circumferential passage 49, and with appropriate communication of the radially extended passageways 46 with the circumferential passages of the manifold finned disc, to separately distribute each of the designated fluid streams to selected circumferential passages of the central finned discs. Similarly, but in reverse order, the two designated streams can be withdrawn from the central finned discs, the manifold finned disc, and the rotative shaft.

Now according to the above modifications in FIG. 14, consider the flow of fluid streams and the manner of heat exchange interactions. A first designated fluid stream V enters zone 83 at shaft end 80 and passes in indirect heat exchange within rotary heat exchange element 59 whereupon it exits the rotary heat exchanger through zone 85 of shaft end 82. A second designated fluid stream W enters zone 84 of shaft end 80 and is passed in indirect heat exchange within rotary heat exchange elements 59, 61, and 63 whereupon it exits the rotary heat exchange through zone 86 of shaft end 82. A first primary fluid stream X enters port 81 and passes in indirect heat exchange within rotary heat exchange element 63 whereupon it exits the rotary heat exchanger through port 79. A second primary stream Y enters the rotary heat exchanger through port 77 and passes in indirect heat exchange within rotary heat exchahge element 61 whereupon it passes into the distribution zone 64. Within zone 64 stream Y is supplemented by admixture with a third primary stream Z entering from port 75. Comingled streams Y and Z (Y+Z) then pass in indirect heat exchange within rotary heat exchange element 59 whereafter they exit the rotary heat exchanger through port 73.

Figure 4:
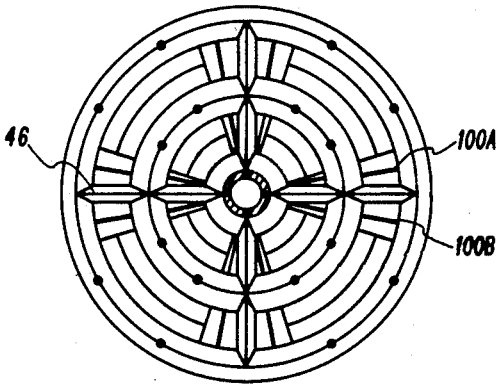
FIG. 4 is a schematic sectional view showing facial details of an alternate geometrical form of a manifold finned disc according to section 45 of FIG. 1.
Figure 5:
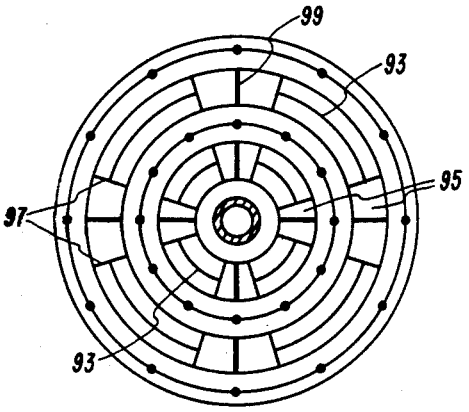
FIG. 5 is a schematic sectional view showing facial details of an alternate geometrical form of a central finned disc according to section 29 of FIG. 1.

Now with respect to the manner of heat exchange interactions, it follows from the preceding flow paths discussion that stream V exchanges countercurrent heat with stream Y+Z and cocurrent heat with stream W. Stream W exchanges countercurrent heat with streams Y+Z, Y, and X which are all three arranged in series one to another. FIGS. 4 and 5 present a modification of the present invention, as shown in FIGS. 2 and 3, relating to means for passing a primary fluid stream axially through and circumferentially about central and manifold discs. FIG. 5 depicts a central finned disc having annular circumferential passages and axially communicating apertures as in FIG. 3. FIG. 5 is different from FIG. 3 in that circumferential passages 93 selected for flow of a primary stream are segmentally divided into a plurality (four shown) of pie-shaped, sectors or sectors of an annulus. Moreover, the segments of circumferential passages are open at each end 97 permitting primary fluid flow into and from each circumferential passage as the rotary heat exchange element rotates. Elongated apertures 99 of the form shown in FIGS. 11, 12, or 13 and constructed for example within the non-finned region 95 (FIG. 5) on the flat disc 35 in FIG. 7; are provided for axial flow of the primary fluid flow between central finned discs and to or from manifold finned discs. With respect to FIG. 4, there is shown a manifold finned disc having sectorial division corresponding to that of FIG. 5 but further having radially extended passages 46 similar in functions and arrangement to those of the manifold finned disc in FIG. 2. Additionally, a set of two elongated apertures 100A and 100B are necessary for the configuration shown because of the flow obstruction imposed by the radially extended passages.

It is physically possible and in some applications operationally practical to assemble a rotary heat exchange element comprising various combinations of manifold finned discs and central finned discs shown in FIGS. 2 and 3, as well as FIGS. 4 and 5. The applications might for example involve condensing or vaporization of a primary stream. Such a change of physical state could be conveniently accommodated using the finned discs of FIGS. 4 and 5 for the large volume gaseous state and the finned discs of FIGS. 2 and 3 for the smaller volume liquid state. Thus, as previously alluded to a rotary heat exchange element might comprise more than two types of finned discs.

Figure 15:
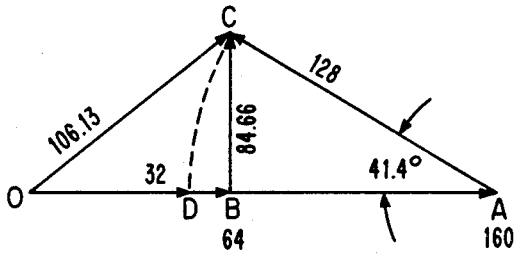
FIG. 15 is a vector diagram depicting fluid stream velocities, magnitudes, and directions according to the method of this invention.

The method of the present invention can be understood upon examining the vector diagram of FIG. 15 which depicts example fluid stream velocities and directions of flow through the apertures. For orientation purposes consider that the plane of the vector diagram corresponds to the plane of the sectional views for apertures shown in FIGS. 11, 12, and 13. For the present example consider an aperture radially disposed 0.95 feet from the center of rotation and rotating at a speed of 1600 RPM. The rotational velocity of the aperture is thus 160 ft/sec as shown by vector OA in FIG. 15. Further consider that the initial circumferential velocity (tangential velocity) of the fluid stream within the circumferential passage is 64.0 ft/sec (vector OB), said initial velocity reflecting mechanical energy induced by the previous heat exchange interaction of the fluid streams and the heat transfer surfaces of the circumferential passages. Next consider that the fluid stream is accelerated to 84.66 ft/sec (vector BC) in a direction perpendicular to the initial circumferential direction, producing a fluid stream velocity now consisting of two velocity components: 64.0 ft/sec and 84.66 ft/sec; which when combined according to vector addition yield a fluid stream velocity of 106.13 ft/sec (vector OC). Hence according to the principles of vector diagrams, we can now say that the velocity of the accelerated fluid streams relative to the rotative circumferential passage is 128 ft/sec at an angle of 41.4° (vector AC). Next suppose that the accelerated fluid stream undergoes a change of direction, say 41.4°, thereby reestablishing a circumferential fluid stream flow direction as prior to acceleration. Once again according to the principles of vector diagrams, it is determined that the deflected velocity of the fluid stream is reduced to 32 ft/sec (vector OD) in a direction which parallels the rotative motion of the subsequent circumferential passage.

Further to the method and apparatus of this invention, the discretionary extensions or vanes 44 (dashed line FIGS. 11, 12, and 13) provide a means for contributing to the acceleration of the fluid streams. When this means is combined with acceleration produced by pressure drop expansion of a fluid stream, it can be shown by vector diagram that the objects of the method of this invention can be achieved. It is further shown that the amount of pressure drop necessary to produce the required fluid stream velocity through the apertures can be reduced or minimized.

Figure 16:
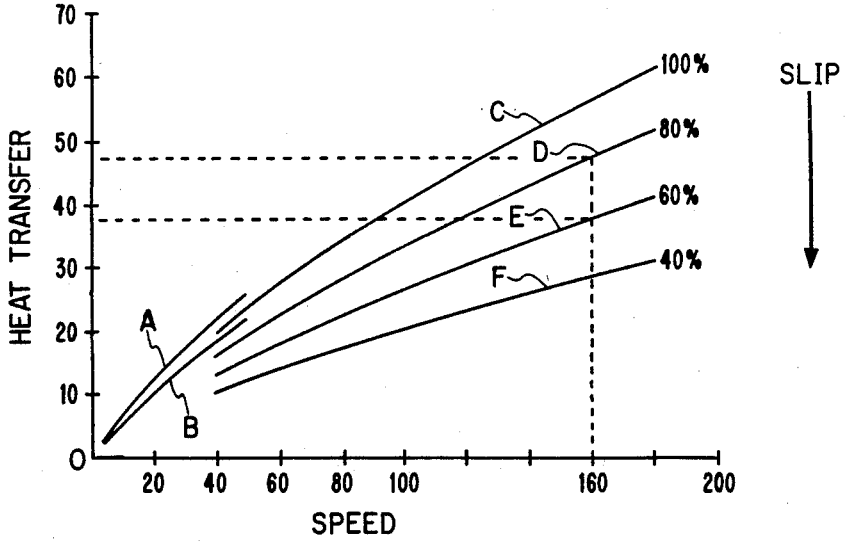
FIG. 16 is a graph representing conventive heat transfer coefficients for conventional radial and axial rotary heat exchangers, and for the apparatus and method of this invention.

The benefits on heat exchange derived from use of the method are understood by considering FIG. 16 which presents approximate convective heat transfer coefficients (ordinate of graph) as related to the velocities of a fluid stream of air (abscissa of graph) flowing along a conductive material surface. FIG. 16 includes several curves illustrating prior art as well as the benefits of the invention of this disclosure. Curve A presents said coefficients for flow between two circular, stationary or co-rotating discs as commonly experienced in the aforementioned radial type rotary heat exchangers. Curve B depicts said coefficients for flow within smooth tubes as commonly experienced in aforementioned axial flow rotary heat exchangers. Both curves A and B are extended to the approximate practical maximum velocities of most fluid streams including air of this example. A series of curves C through F pertain to said coefficients of this invention. The series of curves is necessary to illustrate the effects of relative velocity between the fluid stream and the rotative circumferential heat conducting passages. The degree of relative velocity, designated slip, relates the percentage velocity of the fluid stream compared with the angular, rotative velocity of said passages. Thus for example, at 80% slip in a rotative system having angular velocity of 100 ft/sec relative to a stationary reference, the fluid velocity would be 20 ft/sec relative to the same stationary reference and 80 ft/sec relative to the rotative system. It is the relative velocity or 80 ft/sec in the example, that is important to heat transfer determinations.

Now let us relate the velocity data given in FIG. 15 to the convective heat exchange expectations presented in FIG. 16. Consider that due to prior interaction of a fluid stream in heat exchange relationship with circumferential passages, the velocity of the fluid streams is 64 ft/sec relative to a stationary reference or 96 ft/sec relative to a circumferential passage having 160 ft/sec rotative velocity (1600 RPM). Thus the slip is 60%. From FIG. 16, the convective heat transfer coefficient is observed as 39 BTU/HrFt$^2$ °F. Now following acceleration and redirection of the fluid stream as illustrated in FIG. 15, the fluid stream velocity is reduced to 32 ft/sec relative to a stationary reference or 128 ft/sec relative to a circumferential passage. Thus the slip is 80%. Returning to FIG. 16 and following the dashed line from 60% slip to 80% slip, the convective heat transfer coefficient is read as, 49 BTU/HrFt$^2$ °F. Therefore, use of the method of this invention facilitates improved heat exchange potential of the fluid stream within subsequent circumferential passage by a factor of 49/39 or 1.26.

Further to the heat transfer advantages of the method and apparatus of this present invention, it is shown in FIG. 16 that the maximum practical velocity limitations far exceed those of conventional rotative heat exchanges. While conventional rotative heat exchangers must practically limit fluid stream velocities to approximately 50 ft/sec, the maximum practical velocities limitation of this present invention extends to 200 ft/sec and perhaps to 300 ft/sec in special applications. Thus convective heat transfer coefficient of conventional rotative heat exchangers operating on a fluid stream such as air would be limited to 22 to 26 BTU/HrFt$^2$ °F. (curves B and A, FIG. 16 respectively). In desirable contrast said coefficient of this present invention could be 64 BTU/HrFt$^2$ °F. (curve C, FIG. 16), yielding improvement factors ranging from 2.5 to 2.9.

The decrease in power requirement necessary to affect heat transfer can be understood by considering a balance of energy taken over the acceleration and redirection process steps of this invention. In the following illustrative example, the numerical velocity data of FIG. 15 is considered in conjunction with well known computational relationships involving the kinetic energy of a fluid stream and the exchange of angular momentum of a fluid stream flowing past a rotative material surface. The initial mechanical energy of the fluid stream is 0.1157 horsepower per pound flowing per second (henceforth, lb/sec) based on 64 ft/sec initial velocity. During acceleration to 106.13 ft/sec (vector sum of 32 ft/sec and 84.66 ft/sec), an additional 0.2024 horsepower per lb/sec is added to the initial mechanical energy; yielding a total of 0.3180 horsepower per lb/sec. Upon redirection of the fluid stream, the work done on the rotative surface by the fluid stream is 0.2891 horsepower per lb/sec; which when subtracted from the total 0.3180 horsepower per lb/sec yields 0.0289 horsepower per lb/sec remaining in the fluid stream. This remaining mechanical energy level is the same as that of the fluid stream based on 32 ft/sec. Thus the mechanical energy balance is complete, i.e., initial plus inputs minus outtakes equals final, and we can conclude that neglecting certain minor friction losses, mechanical energies added by the heat exchange and acceleration processes of this invention can be fully recovered; thereby enabling substantial decrease of power requirement necessary to affect heat transfer.

A further embodiment of this invention comprises the use of the Coanda effect as an aid in redirecting the fluid stream. As is well known in the art of aerodynamics including aircraft design, fluidic control devices, and the like; a fluid jet having velocity greater than its surroundings and flowing adjacent (attached) to a material boundary which abruptly changes direction, not to exceed a certain limiting amount; will remain attached to the material boundary thereby cocurrently changing its direction of flow. Employing this effect at edges 30 and 32, FIGS. 11 and 12 respectively; it is therefore possible and conveniently practical to complete the fluid stream redirection to a fully tangential direction (parallel but opposite to the rotation directions R shown in FIGS. 11 and 12). This effect enables simplification compared with the aperture of FIG. 13 which shows smooth and continuous change of direction to the fully tangential direction.

Apertures characterized by the method of this invention need not necessarily be installed in each finned disc of the rotary element. The extent of placement is discretionary depending on the design requirement associated with individual application of the rotary heat exchanger. Stated alternately, the rotary heat exchanger designer can selectively place the apertures of this invention to best achieve the required heat exchange performance and any requirements of pumping or fan action. In place of the apertures of this invention simple orifices or slotted holes, for instance, might suffice. In applications where least pumping or fan action is necessary, the simple orifices or slotted holes should be oriented along the direction of the relative velocity between the fluid and the rotative material surface (angle 41.4 in FIG. 15). For further minimum energy input, it would also be desirable to minimize the acceleration of the fluid stream (vector BC on FIG. 15).

The accelerations of fluid streams as described by this invention can be achieved using any of several means well known to the art. Expansion by pressure drop is a practical means particularly suited to those designated fluid streams previously referenced. Alternatively, pumping or fan action vanes might be integrated with the manifold finned discs. Moreover, said vanes might be incorporated with the apertures by extending one edge according to the dashed lines 44 in FIGS. 11, 12, and 13. This latter means is particularly suited to the previously referenced primary streams.

This invention has been described herein above as a highly flexible heat exchanger having high heat exchange efficiency with low power requirements. As such it is now apparent that this invention has wide application in various industrial fields. The exchanger of this invention can be used in waste heat recover situations, most favorably in those chemical or petrochemical processing plants wherein waste heat from several individual or overlapping temperature ranges can be recovered utilizing the series flexibility disclosed in FIG. 14. The heat exchanger of this invention may also be applied to the radiator, air preheater, or oil cooler of a reciprocating or rotary engine, conserving space and weight by virtue of the high heat exchange efficiency; and reducing power demands on the engine. The heat exchanger of this invention may be further used as a condenser for small steam plants, steam engines, refrigeration processes, and distillation/fractionation processes; enabling smaller, less expensive heat exchangers with reduced temperature approach and power demands. The heat exchanger of this invention may further be used in several commercial and residential applications such as heating water, central heating systems fired by gas, oil or wood energy sources; in solar energy systems; and in freon type air conditioning systems. The heat exchanger of this invention is particularly suited to the heat management systems required in space vehicles and stations. Noteworthy advantages include the flexibilities illustrated in FIG. 14; the ability to provide stable operations in zero gravity environments or in environments which experience varying g-forces; and the advantages of reduced weight, space and power requirements. And lastly, by virtue of eliminating one of the constraints of rotary heat exchangers, namely the excessive power requirements; applications of the heat exchanger of this invention are extended to situations heretofore limited to conventional stationary heat exchangers. Ariel cooler and condensers are noteworthy examples. Also heat pumps and low pressure boilers may be included.

What is claimed is:

1. A rotary heat exchanger for affecting indirect countercurrent and cocurrent heat exchange between a plurality of fluid streams, which comprises:

(a) circular shaped finned discs fabricated from heat conducting materials and configured with internal circumferential passages spaced in annular array;

(b) finned discs coaxially aligned and affixed to a support means which facilitates rotation in predetermined direction and speed about a central axis;

(c) said support means with internal conduit means for separately conveying designated fluid streams to and from said heat exchanger;

(d) said support means with orifices for separately conveying designated fluid streams to and from two manifold finned discs;

(e) said manifold finned discs being said finned discs further configured with manifolding channels generally extending radially to and from said orifices and communicating with circumferential passages provided for designated fluid streams;

(f) said manifold finned discs further confingured with axial flow apertures permitting axially directed flow of designated fluid streams singularly to and singularly from circumferential passages provided for designated fluid streams;

(g) said manifold finned discs further configured with separate circumferential passages provided for primary fluid streams, arranged in radially disposed alternating placement with the circumferential passages for designated fluid streams;

(h) said manifold finned discs further configured with axial flow apertures permitting axially directed flow of primary fluid streams to and from circumferential passages provided for primary fluid streams;

(i) a rotary heat exchanger element formed by materially joining in radially sealed relationship and in functional alignment and facial orientation two manifold finned discs one to another;

(j) predetermined and selected apertures configured with means to accelerate fluid streams in a direction substantially parallel with the direction of the central axis and at substantially right angles to the tangential velocity component induced by heat exchange interaction between the streams and the walls of the rotative circumferential passages;

(k) said predetermined and selected apertures further configured with a directing means which alters fluid streams flow directions and thereby reduces the magnitude of the tangential velocity components and promoting entry of the fluid streams into the proximate circumferential passages;

(l) an enclosure affixed to a stationary support means, having inlet and discharge ports for flow of primary streams, having peripheral sealing means around the circular surface of the rotative heat exchange element, and having space provisions for primary streams flow between the rotative heat exchange element and said ports.

2. The rotative heat exchanger of claim 1 for further affecting series indirect heat exchange between a plurality of designated fluid streams and further comprising:

(a) a plurality of said rotative heat exchange elements coaxially aligned and spaced apart;

(b) common and interconnecting support means for separtely conveying said plurality of designated fluid streams to and from selected said elements;

(c) said common and interconnecting support means for further separately conveying said plurality of designated fluid streams to and from said heat exchanger.

3. The rotative heat exchanger of claim 2 for further affecting series indirect heat exchange between a plurality of primary fluid streams and further comprising:

(a) at least one circular partition disc coaxially aligned with said rotative heat exchange elements and affixed to said support means;

(b) said partition disc selectively placed within the space separting said rotative heat exchange elements thereby forming separated zones for flow of said primary fluid streams;

(c) peripheral sealing means between said partition disc and said enclosure.

4. The rotary heat exchanger of claim 1, 2, or 3 further comprising:

(a) said manifold finned discs further configured with a plurality of first sectors, spaced apart by a plurality of second sectors;

(b) said first sectors consisting of said circumferential passages with said fluid flow apertures for said designated fluid streams in said radially disposed alternating placement with segments of said circumferential passages with said fluid flow apertures for said primary flud streams;

(c) said segments of said circumferential passages having open ends for flow of said primary fluid streams into add from said second sectors;

(d) said second sectors consisting of the continuation of said circumferential passages with said fluid flow apertures for said designated fluid streams in radially disposed alternating placement with the non-finned regions between said segments of said circumferential passages;

(e) said second sectors further including said fluid flow apertures within said non-finned regions to facilitate axially directed flow of said primary streams.

5. A rotary heat exchanger for affecting indirect countercurrent and cocurrent heat exchange between two or more fluid streams, which comprises:

(a) circular shaped finned discs fabricated from heat conducting materials and configured with internal circumferential passages spaced in annular array;

(b) finned discs coaxially aligned and affixed to a support means which facilitates rotation in predetermined direction and speed about a central axis;

(c) said support means with internal conduit means for separately conveying designated fluid streams to and from said heat exchanger;

(d) said support means with orifices for separately conveying designated fluid streams to and from two manifold finned discs;

(e) said manifold finned discs being said finned discs further configured with manifolding channels generally extending radially to and from said orifices and communicating with circumferential passages provided for designated fluid streams;

(f) said manifold finned discs further configured with axial flow apertures permitting axially directed flow of designated fluid streams singularly to and singularly from circumferential passages provided for designated fluid streams;

(g) said manifold finned discs further condigured with separate circumferential passages provided for primary fluid streams, arranged in radially disposed alternating placement with the circumferential passages for designated fluid streams;

(h) said manifold finned discs further configured with axial flow apertures permitting axially directed flow of primary fluid streams to and from circumferential passages provided for primary fluid streams;

(i) a plurality of central finned discs, being said finned discs further configured with circumferential passages corresponding to the radially alternating placements provided manifold finned discs and having axial flow apertures permitting axially directed flow to and from said circumferential passages;

(j) said plurality of central finned discs materially joined one to another in radially sealed relationship and with functional alignment of axial flow apertures, to form a central disc set;

(k) a rotary heat exchange element formed by materially joining in radially sealed relationship and in functional alignment and facial orientation, a manifold finned disc to the first end of a central finned disc set and joining in functional alignment and facial orientation a second manifold finned disc to the second end of said central finned disc set;

(l) predetermined and selected apertures configured with means to accelerate fluid streams in a direction substantially parallel with the direction of the central axis and at substantially right angles to the tangential velocity component induced by heat exchange interaction between the streams and the walls of the rotative circumferential passages;

(m) said predetermined and selected apertures further configured with a directing means which alters fluid streams flow directions and thereby reduces the magnitude of the tangential velocity components and promoting entry of the fluid streams into the proximate circumferential passages;

(n) an enclosure affixed to a stationary support means, having inlet and discharge ports for flow of primary streams, having peripheral sealing means around the circular surface of the rotative heat exchange element, and having space provisions for primary streams flow between the rotative heat exchange element and said ports.

6. The rotative heat exchanger of claim 5 for further affecting series indirect heat exhange between a plurality of designated fluid streams and further comprising:

(a) a plurality of said rotative heat exchange elements coaxially aligned and spaced apart;

(b) common and interconnecting support means for separately conveying said plurality of designated fluid streams to and from selected said elements;

(c) said common and interconnecting support means for further separately conveying said plurality of designated fluid streams to and from said heat exchanger.

7. The rotative heat exchanger of claim 6 for further affecting series indirect heat exchange between a plurality of primary fluid streams and further comprising:

(a) at least one circular partition disc coaxially aligned with said rotative heat exchange elements and affixed to said support means;

(b) said partition disc selectively placed within the space separating said rotative heat exchange elements thereby forming separated zones for flow of said primary fluid streams;

(c) peripheral sealing means between said partition disc and said enclosure.

8. The rotary heat exchanger of claim 5, 6, or 7 further comprising:

(a) said manifold and said central finned discs further configured with a plurality of first sectors, spaced apart by a plurality of second sectors;

(b) said first sectors consisting of said circumferential passages with said fluid flow apertures for said designated fluid streams in said radially disposed alternating placement with segments of said circumferential passages with said fluid flow apertures for said primary fluid streams;

(c) said segments of said circumferential passages having open ends for flow of said primary fluid streams into and from said second sectors;

(d) said second sectors consisting of the continuation of said circumferential passages with said fluid flow apertures for said designated fluid streams in radially disposed alternating placement with said non-finned regions between said segments of said circumferential passages;

(e) said second sectors further including said fluid flow apertures within said non-finned regions to facilitate axially directed flow of said primary streams.

* * * * *